United States Patent [19]

Clark, Jr. et al.

[11] 4,209,857

[45] Jul. 1, 1980

[54] PROCESS FOR MANUFACTURING WORK GLOVES

[76] Inventors: L. Jack Clark, Jr., 2110 Hollywood Rd., Atlanta, Ga. 30318; David L. Clark, 174 Confederate St., Dallas, Ga. 30132

[21] Appl. No.: 17,361

[22] Filed: Mar. 5, 1979

[51] Int. Cl.[2] ..... A41D 19/02

[52] U.S. Cl. ..... 2/169

[58] Field of Search ..... 2/169, 159, 243 B, 243 R

[56] References Cited

U.S. PATENT DOCUMENTS

| | | | |
|---|---|---|---|
| 1,538,263 | 5/1925 | Ackerman | 2/169 |
| 1,538,269 | 5/1925 | Ackerman | 2/169 |
| 3,923,577 | 12/1975 | Baab | 2/169 |
| 4,034,853 | 7/1977 | Smith | 2/169 |

*Primary Examiner*—Werner H. Schroeder
*Assistant Examiner*—Doris L. Troutman

[57] ABSTRACT

Two layers or cloth or other material are quilted together by embroidery stitching to outline on the material multiple rows of repetitive glove body shapes. The multiple pre-stitched glove bodies thus formed integrally with the quilted material layers are separated from the material by die cutting around the margins of the glove bodies slightly outside of the stitching lines which delineate them in the quilted material. Cuffs are attached to the separated pre-stitched glove bodies by conventional procedures, followed by turning the gloves inside-out and inspecting the finished gloves. Manual labor commonly involved in sewing glove body pieces together and closing glove bodies is eliminated.

8 Claims, 2 Drawing Figures

PROCESS FOR MANUFACTURING WORK GLOVES

BACKGROUND OF THE INVENTION

Traditionally, gloves such as work gloves are manufactured in a seven step method which comprises:

1. Spreading the cloth;
2. Cutting the glove pattern or pieces;
3. Sewing the pieces together;
4. Closing the glove body;
5. Attaching the cuff to the glove body;
6. Turning the glove inside-out;
7. Inspecting the finished glove.

In the above method, the cut pieces are carried to seamstresses where the pieces are joined together using conventional sewing equipment and the glove body is closed by further sewing operations. Both of these steps designated (3) and (4) above involve considerable manual work and are time-consuming and costly.

The objective is to improve on the traditional manufacturing process first by reducing the basic number of manufacturing steps and further by eliminating a great amount of the time-consuming manual labor which was involved primarily under steps (3) and (4) of the traditional method. As a result, the method embodied in this invention is much more economical in the overall. Steps (1) through (4) of the traditional method have been eliminated and have been replaced by only two operations or steps which are performed automatically, thus eliminating the manual labor previously involved in the sewing operations. The new and simplified method of manufacturing gloves comprises the following steps:

1. Quilting two layers of cloth or other material preferably by embroidery stitching to produce multiple repetitive glove body outlines or patterns integrally in the quilted material.
2. Die cutting around the margins of the multiple glove bodies immediately outwardly of their stitching lines to cleanly separate pre-sewn glove bodies from the quilted layered material.
3. Attaching cuffs conventionally to the pre-sewn glove bodies.
4. Turning the gloves inside-out.
5. Inspecting the finished gloves.

It can be observed by comparing the traditional and improved methods of manufacturing gloves that the principal difference lies in the fact that the main method steps are reversed in the new method. In the traditional method, the individual glove body pieces are first cut out of sections of material and are then sewn together to produce glove bodies. In the present method, the glove bodies are sewn first in the quilted layered material and are then cut and separated from the material in a substantially completed state, needing only to have the cuff attached and to be turned and inspected.

While the invention is applicable to work gloves formed of cloth, it is not limited to this type of glove and can be employed to produce leather gloves or gloves formed of plastics or other suitable materials. In some cases, lined gloves can be produced by the method merely by inserting lining layers of material in the lay-up prior to the quilting operation.

Other features and advantages of the invention will become apparent during the course of the following description.

The below-listed known prior art patents of general interest only are made of record herein under 37 C.F.R. 1.56:

U.S. Pat. Nos. 1,538,262; 1,538,263; 1,811,570; 2,847,676; 3,866,245; 3,945,049.

DETAILED DESCRIPTION

Figure 1:
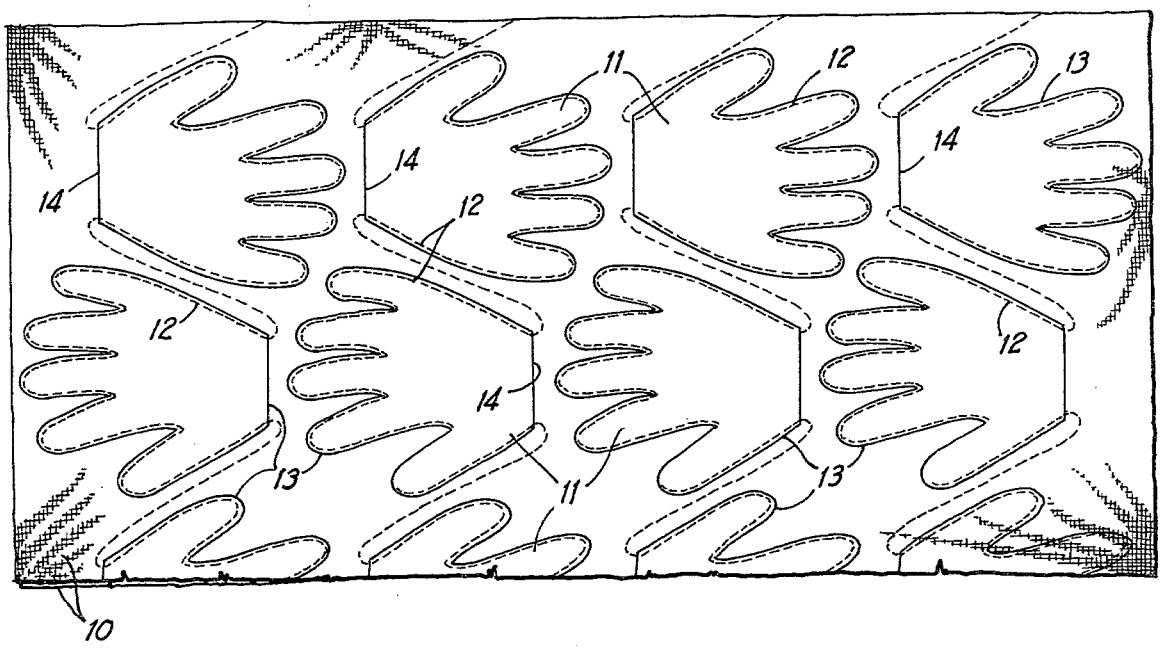
FIG. 1 is a fragmentary plan view of layered material quilted by stitching to produce integrally therein multiple glove bodies of preselected shape.

Referring to the drawings in detail, wherein like numerals designate like parts throughout, the numeral 10 designates at least two layers of cloth or other material used to produce pre-sewn glove bodies 11 in accordance with this invention. Additional layers of material are included in the lay-up if it is desired to produce gloves with linings. Typical work gloves made according to the invention involve two layers of cloth.

Utilizing an automatic lockstitch quilting machine, a continuous roll of the layered material 10 is quilted, preferably employing embroidery stitching and the quilted material may be rewound into a roll upon leaving the quilting machine. In the quilting operation, multiple repetitive closely interfitting parallel rows of the pre-stitched glove bodies 11 according to a selected pattern are produced integrally in the layered material 10 by lines of quilting embroidery stitching 12 which delineate the shapes of the multiple glove bodies 11.

Following this quilting operation which produces the pre-sewn glove bodies, the quilted material is fed into a fully automatic traveling head die press, not shown, of conventional construction and operation. The automatic lockstitch quilting machine, not shown, is also conventional equipment. The die press utilizes cookie cutter type dies of the same shapes as the glove bodies 11 but slightly larger than the areas encompassed by the lines of stitching 12. These dies cut cleanly through the quilted material 10 slightly outside of the lines of stitching 12 along marginal cutting lines 13 to separate the pre-sewn glove bodies 11 from the quilted roll of material 10 leaving very little scrap material. The wrist ends 14 of the die cut pre-sewn glove bodies 11 are open. It may be noted that substantially no direct manual labor is involved in the production of the pre-sewn glove bodies 11 as a result of the described quilting and die cutting method steps. This distinguishes sharply from the prior art wherein cut pieces to make up glove bodies are sewn together and then closed by seamstresses utilizing conventional sewing machines.

Figure 2:
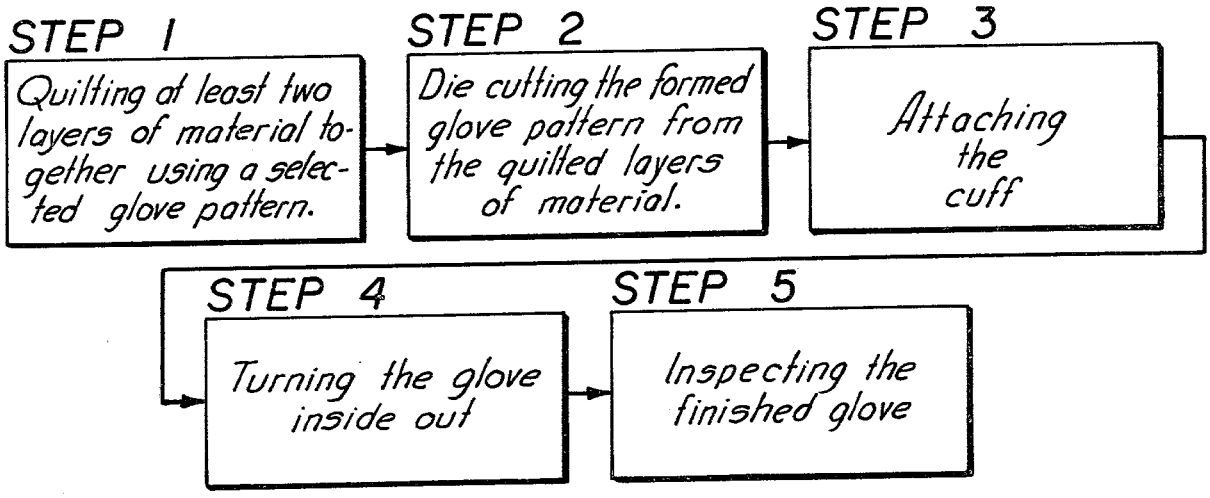
FIG. 2 is a flow chart depicting method steps embodied in the invention.

Following the described quilting and die cutting steps, namely, steps (1) and (2) in FIG. 2, all that remains to produce finished gloves is the attachment of cuffs to the wrist ends of the glove bodies 11 in a conventional manner, step (3), followed by turning each glove inside-out, step (4), and finally inspecting the finished glove, step (5), the final step in the improved method.

The economic and labor-saving advantages of the present invention over the prior art should now be readily apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. In a method of manufacturing gloves, the steps of quilting superposed layers of material together with lines of stitching forming the outlines of multiple glove bodies connected integrally with said material, and die cutting the quilted material on cutting lines slightly outside of said lines of stitching and following the lines of stitching to separate pre-sewn glove bodies from said quilted material.

2. The method of claim 1, and attaching cuffs to wrist ends of the glove bodies.

3. The method of claim 2, and turning the resulting glove inside-out and inspecting it.

4. The method of claim 1, wherein said quilting lines of stitching comprise embroidery stitching.

5. The method of claim 1, and interrupting the lines of stitching forming said outlines of the glove bodies at the wrist ends of the glove bodies to thereby produce open wrist ends on the glove bodies following said die cutting.

6. The method of claim 1, wherein the quilting of said layers of material with said lines of stitching forms in the material multiple rows of said glove bodies with the glove bodies of adjacent rows in end-to-end oppositely facing directions and in interfitting relationship to minimize waste material.

7. The method of claim 6, and said lines of stitching forming the outlines of the glove bodies comprising continuous lines of stitching from row-to-row of glove bodies and interconnecting the wrist ends of glove bodies which are in side-by-side pairs in adjacent rows.

8. A method of manufacturing gloves comprising the steps of quilting layered material along lines which define in the material plural glove bodies of a preselected shape and size integral with the material, and then separating the glove bodies from the material by cutting through the material along lines following and slightly outside of the quilting lines and thus producing from the material substantially completed glove bodies.

* * * * *